United States Patent [19]

Rollenitz et al.

[11] Patent Number: 4,603,811

[45] Date of Patent: Aug. 5, 1986

[54] INJECTION UNIT ASSOCIATED WITH EACH CYLINDER OF A MULTICYLINDER DIESEL ENGINE

[75] Inventors: Leopold Rollenitz, Kirchstetten; Harald Schmidt, Vienna; Otto Freudenschuss, Vienna; Josef Morell, Vienna, all of Austria

[73] Assignee: Steyr-Daimler-Puch AG, Vienna, Austria

[21] Appl. No.: 608,977

[22] Filed: May 10, 1984

[30] Foreign Application Priority Data

Jun. 6, 1983 [AT] Austria ..... 2055/83

[51] Int. Cl.[4] ..... F02M 47/02

[52] U.S. Cl. ..... 239/90; 417/499

[58] Field of Search ..... 239/88–92; 417/494, 499

[56] References Cited

U.S. PATENT DOCUMENTS

| | | | |
|---|---|---|---|
| 2,315,907 | 4/1943 | Starr | 123/32 |
| 2,717,805 | 9/1955 | Seifert et al. | 239/90 |
| 3,343,798 | 9/1967 | Senft | 239/90 |

FOREIGN PATENT DOCUMENTS

| | | | |
|---|---|---|---|
| 0055245 | 6/1982 | European Pat. Off. . | |
| 1245130 | 9/1971 | United Kingdom . | |
| 1330455 | 9/1973 | United Kingdom | 239/88 |
| 2069624 | 8/1981 | United Kingdom . | |

*Primary Examiner*—Joseph F. Peters, Jr.
*Assistant Examiner*—Michael J. Forman
*Attorney, Agent, or Firm*—Ernest F. Marmorek; Charles Guttman; Kenneth Rubenstein

[57] ABSTRACT

An injection unit which is associated with a cylinder of a multicylinder diesel engine and comprises an injection nozzle and an injection piston pump which is disposed in a common housing and is driveable by a cam shaft. Said pump comprises a rotatable pump piston which is displaceable in a pump cylinder and has two control edges disposed axially spaced from each other for at least one fuel passage of the pump cylinder. To obtain the desired injection accuracy by accurately observing only a few dimensions during the production and without further tests, measuring and adjusting operations, the pump piston (3) and the pump cylinder (14) each comprise at least one stop face (24, 25) extending transversely preferably normal to the pump longitudinal axis. Said faces cooperate in the basic position of the pump piston (3) assumed in the installation of the unit in the engine directly or indirectly with simultaneous rotational position fixing of the pump piston (3).

4 Claims, 6 Drawing Figures

INJECTION UNIT ASSOCIATED WITH EACH CYLINDER OF A MULTICYLINDER DIESEL ENGINE

FIELD OF THE INVENTION

Figure 1:
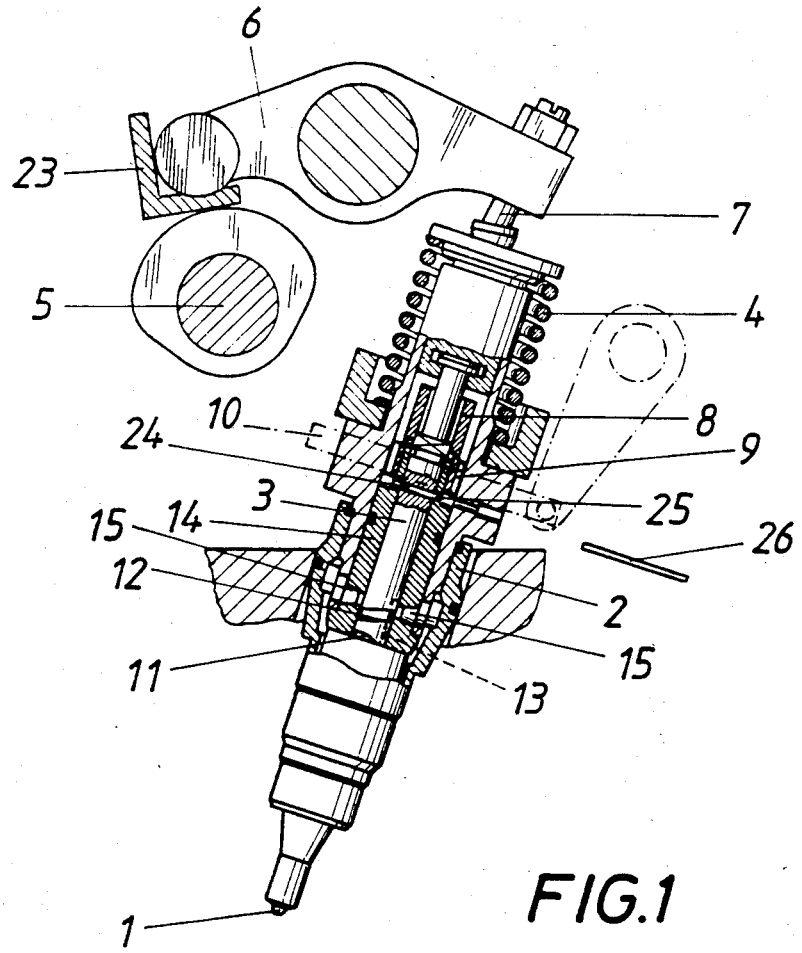

The invention relates to an injection unit associated with each cylinder of a multicylinder diesel engine and comprising an injection nozzle and an injection piston pump which is disposed in a common housing, is driveable by a cam shaft via a rocker lever and a longitudinally adjustable connecting tappet with comprises a rotatable pump piston with two control edges disposed axially spaced from each other and a pump cylinder enclosing the piston and having at least one fuel passage passing transversely therethrough.

BACKGROUND OF THE INVENTION

Known injection units of this type are generally actuated by a cam shaft mounted in the engine cylinder head, the pump piston being rotatable by means of a toothed control rod engaging in a gear of the pump piston for adjusting the displacement. As soon as the control edge provided at the piston end face has passed the mouth of the fuel passage and has thus enclosed the fuel in the cylinder in front of the piston end face, after a corresponding pressure rise, fuel discharge begins from the injection nozzle. If the rear control edge formed by a step in the piston running surface and connected to the piston end face via a passage formed as a groove or the like then frees the mouth of the fuel passage after further piston travel, the fuel discharge from the nozzle is terminated and the fuel conducted into the passage.

DESCRIPTION OF PRIOR DISCLOSURE

GB-PS 2,069,624 already discloses an injection unit of this type in which the injection instant can be defined in that, in the pump piston, an annular groove normal to the axis is provided against one shoulder wherein a spring-loaded pin mounted in a sleeve of the pump housing displaceable normally to the axis thereof can be brought to bear against the force of the piston spring, the pump piston thereby being disposed in a fixed position with respect to the fuel passage of the pump housing. When the cam drive of the pump piston has been appropriately adjusted the pin is withdrawn by its spring and allows the travel of the pump piston.

A disadvantage in the known injection unit is due to the play existing between the parts and the bending moment in the pin. This is due to the one-sided arrangement of the pin and its one-sided engagement in the pump piston so that no exact adjustment of the pump piston with respect to the fuel passage of the pump housing is possible.

Thus, for critical dimensions as regards the injection accuracy the cooperating individual components of known injection units give long tolerance chains. Thus, even with accurate production methods it is impossible to supply without further tests, measurements and adjustment work for each injection unit in a basic setting in which a quite definite pump displacement and an exact displacement start at a defined engine operating point are ensured. Therefore, hitherto, to enable the demands made on the accuracy of fuel injection to be met to a sufficient extent each injection unit had to be firstly set to the desired pump displacement on the pump testing bench by rotating the piston. In this adjustment the control rod is fixed, for example, by an adjustment screw. Also, the axial position of the pump piston at which the mouth of the fuel passage is just closed by the control edge at the piston end face is measured and after installation of the unit into the engine the length of the connecting tappet between the rocking lever and the unit is adjusted so that in the rotational position of the cam shaft corresponding to the start of displacement the injection unit concerned does in fact begin to deliver. In addition, the control rod of each unit is connected to the control means of the diesel engine.

A disadvantage with this method is that the expenditure of time both for the work on the pump testing bench and for the engine assembly is very high, that it can only be carried out by suitably trained personnel and in addition requires a considerable expenditure on apparatus.

OBJECTS AND SUMMARY OF THE INVENTION

An object of the invention is therefore to provide an injection unit of the type above-mentioned (outlined at the beginning) with which simply by keeping to a few dimensions during production it is ensured that the desired injection accuracy is achieved without further testing, measuring and adjustment operation.

Other objects will in part be obvious and in part disclosed below.

The invention achieves the above object in that the pump piston and the pump cylinder of the invention each comprise at least one stop face extending transversely preferably normal to the pump longitudinal axis, which in the basic position of the pump piston assumed on installation of the unit into the engine cooperate directly or indirectly with simultaneous rotational position fixing of the pump piston, and that when the stop faces are normal to the axis for fixing the rotational position of the pump piston with respect to the pump cylinder in the piston basic position on the pump piston and on the pump cylinder in each case an engagement surface parallel to the pump longitudinal axis is provided for each other.

Since to define the displacement start and the displacement magnitude the mutual arrangement of the control edges on the pump piston, on the one hand, and on the mouth of the fuel passage in the pump cylinder on the other hand, is important, in production it is only necessary to maintain the distance of the stop faces on the pump piston from the control edges thereof, the distance of the stop face on the pump cylinder from the mouth of the fuel passage likewise to be exactly formed and the rotational angle of the control edges and position of the passage mouth with respect to the stop faces and the engagement faces respectively, the engagement faces only being necessary in the case of stop faces extending normally to the pump longitudinal axis of fixing the rotational position of the pump piston with respect to the pump cylinder. In the case of stop faces extending inclined to the pump longitudinal axis the correct rotational position of the piston arises automatically when said stop faces are brought into engagement in the basic position of the pump piston in the unit assembly. When the stop faces and possibly the engagement faces lie on each other the correct position of the control edges and the passage mouth with respect to each other is ensured by the few production dimensions referred to. This avoids long tolerance chains so that the test, measurement and adjustment work on a special pump test bench and the time-consuming assembly work by specially trained personnel can be dispensed with.

In a further embodiment of the invention, the stop face of the pump piston extending normally to the pump longitudinal axis is provided on a collar thickened with respect to the piston diameter and as a stop face of the pump cylinder the end face thereof normal to the axis and facing the collar is used, the engagement face on the piston being formed by a collar flattening and the engagement face on the pump cylinder cooperating therewith being formed by a side face of a projection of the end face. These stop and engagement faces can be made simply and accurately and there is also no difficulty in maintaining with close tolerance the longitudinal and angular distances of the control edges and the passage mouth from said faces. For assembly it is only necessary to bring the respective injection cam of the engine into the corresponding position, for example, into the position of maximum cam travel, and with interposition of a gauge between cam and rocker levers to obtain the necessary clearance travel, tighten the connecting tappet as far as possible until the stop faces of the pump piston and cylinder bear against each other. In addition, the control rod of the unit is to be coupled to the control means of the diesel engine. After removal of the gauge the pump spring pulls the pump piston into the position which gives the correct delivery start in engine operation. The correct displacement amount corresponding to the rotational position of the pump piston is thus also fixed.

To obtain an easy bringing together of the engagement faces of the pump piston and cylinder without having to adjust the correct rotational position of the pump piston by hand, according to the invention, the engagement face of the projection directly adjoining the stop face of the pump cylinder formed by the end face and parallel to the axis thereof merges into an inclined guide face. Of course, the engagement face on the pump cylinder may be made narrow, in the limit case reduced to a line. In this case as well, on tightening of the connecting tappet the pump piston turns with mutual sliding of the engagement faces on each other into the correct rotational position.

A further simplification in the production and assembly results if, according to the invention, the indirectly cooperating stop faces of the pump piston and pump cylinder are formed by wall portions of a cylinder or prismatic passage opening which are directed normally to the pump longitudinal axis and which are adapted to be traversed jointly by a pin or the like of corresponding cross-section, the pin introduced into the passage opening ensuring both the correct position of the pump piston in the direction of the pump piston and the correct rotational position of the pump piston. It is then only necessary to adjust the connecting tappet until the pin can be detached from the passage openings.

Improved accuracy can be achieved if the passage openings and the pin have circular cross-sections. The pump spring tends to move the piston to its uppermost position so that the stop faces formed from wall portions of the passage openings made, for example, as bores of the piston and cylinder come into alignment via the pin made very accurately as a circular cylindrical pin. The pin diameter may also be appreciably smaller than the diameters of the passage openings because the pin is guided by the curvatures of the stop faces under the action of the pump spring force into a clearly defined end position, thereby also fixing the mutual arrangement of piston and cylinder. To assemble, it is only necessary to tighten the connecting tappet with the cam shaft in coresponding rotational position until the pump spring force is supported on the tappet, releases the pin and the latter can be easily removed. In addition, of course, the control rod of the unit is to be connected to the engine control means.

To eliminate possible fractional influences between pin and passage openings, the wall portions serving as stop faces of the passage openings are formed in each case by two roof-like opposite planar faces and the pin has corresponding counter faces. The planar faces sliding on each other under the pump spring force ensure the basic position of the pump piston both as regards its rotational and its longitudinal position particularly exactly and independently of any small frictional forces which might occur between pin and walls.

According to a further embodiment of the invention the passage openings and the pin are of rectangular cross-section, the walls of the passage openings extending normally or parallel to the pump longitudinal axis. The walls of the passage openings extending normally to the pump longitudinal axis serve as stop surfaces whereas the axis-parallel walls serve as engagement surfaces for fixing the rotational position of the pump piston.

The basic position of the pump piston in assembly of an injection unit constructed in this manner can also be fixed in that the piston is brought to bear on the pin against the force of the pump spring by tightening the tappet, the pin being in turn held in engagement with the stop faces in the cylinder by adjustment screws, wedges or similar means against the force of said tappet. This results in a setting less influenced by the feeling of the fitter than is the case when as described above the basic position of the pump piston is defined only by the action of the pump spring force. Depending on the assembly procedure adopted, the spacings to be observed in the production with regard to the stop faces used must of course be defined.

Figure 2:
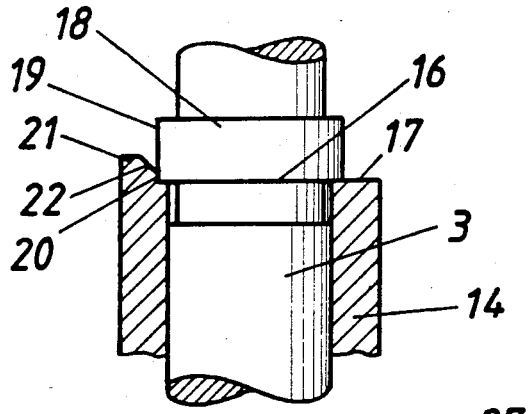
Figure 4:
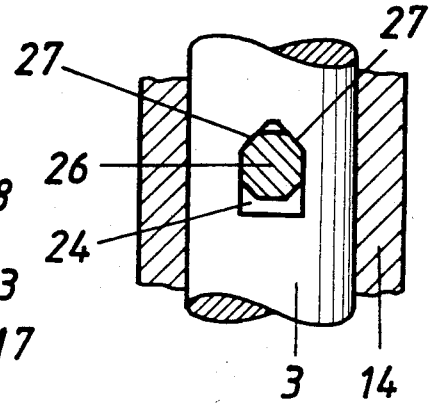
Figure 3:
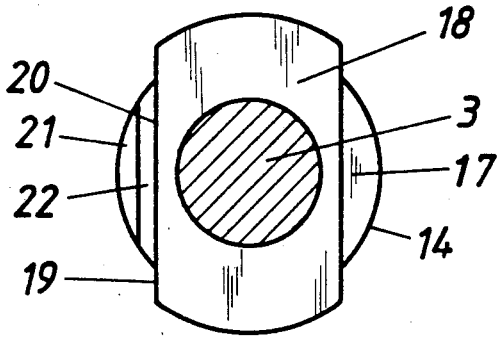
Figure 5:
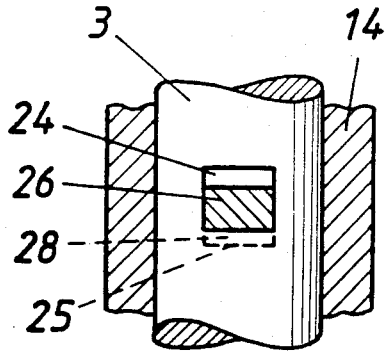
Figure 6:
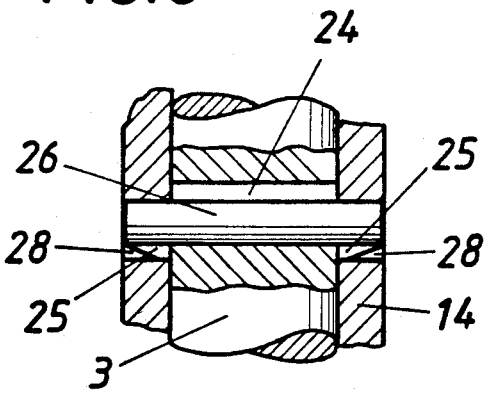

An embodiment of the invention is illustrated in the drawings, wherein:

FIG. 1 shows partly in section an injection unit with drive means associated with a cylinder of a diesel engine, FIG. 2 shows part of the pump piston or cylinder of the invention with the stop or engagement faces to a larger scale in partial section, FIG. 3 is a cross-section along line III—III of FIG. 2, FIG. 4 is a variant illustrated in a manner corresponding to FIG. 2, FIG. 5 is a further possible embodiment and FIG. 6 is a vertical cross section through the piston axis as shown in FIG. 5 and rotated through 90°.

DISCLOSURE OF BEST MODES

The injection unit of the invention consists of an injection nozzle 1 and an injection piston pump disposed in a common housing 2. The injection pump comprises a pump piston 3 which is loaded by a spring 4 and is moved or driven against the force of said spring 4 by a cam shaft via a rocker lever 6 and a longitudinally adjustable connecting tappet 7. Piston 3 is connected non-rotatably to a sleeve 8 which comprises a toothing 9 with which a rack 10 meshes. With the aid of this rack 10 and the sleeve 8 it is therefore possible to turn the piston 3. The piston 3 comprises at the bottom two axially spaced control edges 11, 12 which are connected together by a groove 13. 14 denotes the pump cylinder which encloses the piston 3 and comprises two fuel passages 15 passing transversely therethrough.

As soon as in the downwardly directed piston stroke the control edge 11 has passed the mouth of the fuel passage 15 and the fuel has been enclosed in the cylinder 14 in front of the piston end face, after a corresponding pressure rise in the cylinder 14, fuel injection from the nozzle 1 starts. When after further piston travel the control edge 12 frees the mouth of the fuel passages 15, due to the connecting groove 13 the fuel discharge from the nozzle 1 is terminated and the fuel conducted into the passages 15.

To bring the pump piston during the basic assembly into the position which when the engine is operating gives the correct displacement start and the correct pump displacement amount, in accordance with FIGS. 2 and 3, there are provided on the pump piston 3, on the one hand, and, on the pump cylinder 14, on the other hand, stop faces 16, 17, the piston 3 having a collar 18 thickened with respect to the piston diameter so that the stop face 16 is provided on said collar 18 and as stop face 17 of the pump cylinder 14 the end face thereof facing the collar 18 is provided. The collar 18 comprises a flattening 19 which as engagement face cooperates with an engagement face on the pump cylinder 14 formed by the side face 20 of a projection 21 of the end face of said cylinder 14, the engagement face 20 merging into an inclined guide face 22. For assembly it is only necessary to bring the injection cam of the engine into the desired position, e.g. into the position of maximum piston stroke (FIG. 1) and with interposition of a gauge 23 between the cam and the rocker lever 6 to obtain the necessary clearance to tighten the tappet 7 until the stop faces 16, 17 of the pump piston 3 and cylinder 14 bear on each other. By providing the guide face 22 and the engagement face 19, 20, the correct rotational position of the pump piston 3 is also achieved.

According to FIGS. 1 and 4–6 the stop or abutment faces of the pump 3 and of the pump cylinder 14 cooperating indirectly in this case are formed by wall portions of, in each case, a cylindrical or prismatic passage opening 24, 25 which are directed normally to the pump longitudinal axis and are adapted to be traversed by a pin 26. The passage openings 24, 25 and the pin 26 may have circular cross-sections. In accordance with FIG. 4, however, the wall portions of the passage openings 24, 25 serving as stop faces are formed in each case by two roof-like opposite planar faces 27, the pin 26 having corresponding counter faces. According to FIGS. 5 and 6 the passage openings 24, 25 have a rectangular cross-section, the walls of the passage openings 24, 25 extending normally or parallel to the pump longitudinal axis.

During assembly the tappet 7 is tightened with the cam shaft 5 in the corresponding rotational position until the pin 26 is released and can be easily removed. According to FIG. 5 the basic position of the pump piston 3 can also be fixed in that the piston 3 is brought to bear against the force of the spring 4 on the pin 26 by tightening the tappet 7 and said pin is held by wedges 28 against the force of said tappet on the stop faces in the cylinder 14 formed by the passage openings 25.

We claim:

1. A fuel injection unit associated with each engine cylinder of a multi-cylinder diesel engine having an injection nozzle and an injection pump disposed in a common elongated housing, said injection unit actuated by cam means via a rocker lever and a longitudinally adjustable tappet, said injection pump comprising, a pump cylinder having at least one fuel passage passing transversely therethrough, a rotatable pump piston disposed within said pump cylinder, said pump piston having a piston head with two inclined control edges, said control edges longitudinally spaced from each other on said piston head, said control edges cooperating with said fuel passage for receiving fuel into said pump cylinder and for injecting fuel into its associated engine cylinder via said injection nozzle, said pump cylinder and said pump piston including adjustment means for simultaneously adjusting the longitudinal and rotational orientation of said pump piston relative to said pump cylinder upon installation of said fuel injection unit in its associated engine cylinder, said adjustment means comprising, a first stop face located on said pump piston, a second stop face located on said pump cylinder, said first and second stop faces extending transversely to the longitudinal axis of said pump cylinder, said first and second stop faces abutting against each other to fix the longitudinal position of said pump piston relative to said pump cylinder upon installation of said fuel injection unit in its associated engine cylinder, a first engagement surface located on said pump piston, and a second engagement surface located on said pump cylinder, said first and second engagement surfaces being substantially parallel to the longitudinal axis of said pump cylinder, said first and second engagement surfaces abutting against each other to fix the rotational orientation of said pump piston relative to said pump cylinder upon installation of said fuel injection unit in its associated engine cylinder.

2. The fuel injection unit of claim 1 wherein said adjustment means includes a collar mounted on a shaft of said pump piston, said collar having an end face normal to said longitudinal axis and a substantially flat side parallel to said longitudinal axis, said first stop face being said end face and said first engagement surface being said flat side.

3. The fuel injection unit of claim 2 wherein said pump cylinder has a projection extending toward said pump piston, said second engagement surface comprising a side face of said projection.

4. The fuel injection unit unit of claim 3 wherein said side face of said projection is upwardly inclined.

* * * * *